US006422900B1

(12) United States Patent
Hogan

(10) Patent No.: US 6,422,900 B1
(45) Date of Patent: Jul. 23, 2002

(54) COAXIAL CABLE COUPLING DEVICE

(75) Inventor: Edward F. Hogan, Monterey, CA (US)

(73) Assignee: HH Tower Group, Monterey, CA (US)

( * ) Notice: Subject to any disclaimer, the term of this patent is extended or adjusted under 35 U.S.C. 154(b) by 0 days.

(21) Appl. No.: 09/396,846

(22) Filed: Sep. 15, 1999

(51) Int. Cl.[7] ..... H01R 9/05

(52) U.S. Cl. ..... 439/578; 439/98; 174/78; 174/78 C; 174/73.1

(58) Field of Search ..... 439/578, 583, 439/851, 852, 841, 842, 98; 174/73.1, 91, 92, 84 R, 84 S, 85

(56) References Cited

U.S. PATENT DOCUMENTS 3,568,128 A * 3/1971 Taylor ..... 339/14
4,046,451 A 9/1977 Juds et al.
4,056,299 A 11/1977 Paige
4,163,598 A 8/1979 Bianchi et al.
4,184,729 A 1/1980 Parks et al.
4,662,067 A 5/1987 Abraham
4,739,126 A * 4/1988 Gutter et al. ..... 174/65 SS
4,740,794 A 4/1988 Phillips et al.
4,768,004 A 8/1988 Wilson
4,773,879 A 9/1988 Pauza et al.
4,813,639 A 3/1989 Midkiff et al.
4,836,791 A 6/1989 Grabbe et al.
4,964,814 A 10/1990 Tengler et al.
4,973,259 A * 11/1990 Sachs ..... 439/98
5,046,966 A 9/1991 Snyder et al.
5,060,373 A 10/1991 Machura et al.
5,083,929 A * 1/1992 Dalton ..... 439/98
5,122,068 A * 6/1992 Koss ..... 439/98
5,137,470 A 8/1992 Doles et al.
5,154,636 A 10/1992 Vaccaro et al.
5,167,533 A 12/1992 Rauwolf
5,169,343 A 12/1992 Andrews et al.
5,184,965 A 2/1993 Myschik et al.
5,217,391 A 6/1993 Fisher, Jr.
5,273,457 A 12/1993 Zell et al.
5,280,254 A 1/1994 Hunter et al.
5,293,298 A 3/1994 Foglia
5,334,051 A 8/1994 Devine et al.
5,354,217 A 10/1994 Gabel et al.
5,380,216 A 1/1995 Broeksteeg et al.
5,393,021 A 2/1995 Nelson
5,401,175 A 3/1995 Guimond et al.
5,417,588 A 5/1995 Olsone et al.
5,435,745 A 7/1995 Booth
5,453,756 A 9/1995 Lowrey
5,454,734 A 10/1995 Egfert et al.
5,460,533 A 10/1995 Broeksteeg et al.
5,467,062 A 11/1995 Burroughs
5,487,681 A 1/1996 Star et al.
5,493,702 A 2/1996 Crowley et al.
5,518,422 A 5/1996 Zell et al.

(List continued on next page.)

*Primary Examiner*—Anh Mai
*Assistant Examiner*—Kyung S. Lee
(74) *Attorney, Agent, or Firm*—Beyer Weaver & Thomas, LLP

(57) ABSTRACT

A connector assembly for coupling a continuous length of coaxial cable to a bulkhead is disclosed. The coaxial cable includes an insulation layer disposed around an outer conductor. The connector assembly includes a first conductive mounting member having an inner peripheral surface that is configured to mate with an outer peripheral surface of the outer conductor for a segment of the continuous length of the coaxial cable. The first conductive mounting member also includes a first bulkhead mating portion that is configured to mate with the bulkhead. The connector assembly further includes a fastener that is configured to couple the first conductive mounting member to the outer conductor of the segment of the continuous length of the coaxial cable, wherein the continuous length of the coaxial cable is uninterrupted within the connector assembly.

18 Claims, 6 Drawing Sheets

U.S. PATENT DOCUMENTS 5,562,462 A 10/1996 Matsuba et al.
5,563,562 A 10/1996 Szwec
5,570,068 A 10/1996 Quan
5,595,502 A 1/1997 Allison
5,657,196 A 8/1997 Chaudhry et al.
5,711,014 A 1/1998 Crowley et al.
5,711,676 A 1/1998 Michael, III
5,713,748 A * 2/1998 Mulvihill ..... 439/98
5,724,220 A 3/1998 Chaudhry et al.
5,751,534 A 5/1998 DeBalko
5,758,004 A 5/1998 Alarcon et al.
5,768,084 A 6/1998 Chaudhry et al.
5,775,934 A 7/1998 McCarthy
5,782,656 A 7/1998 Zell et al.
5,785,548 A 7/1998 Capper et al.
5,794,897 A 8/1998 Jobin et al.
5,795,188 A 8/1998 Harwath
5,802,710 A 9/1998 Bufanda et al.
5,803,768 A 9/1998 Zell et al.
5,807,126 A 9/1998 Bethurum
5,809,429 A 9/1998 Knop et al.
5,815,122 A 9/1998 Nurberger et al.
5,831,198 A 11/1998 Turley et al.
5,850,056 A * 12/1998 Harwath ..... 174/40 CC
RE36,065 E 1/1999 Andrews et al.
5,879,188 A 3/1999 Clyatt

* cited by examiner

COAXIAL CABLE COUPLING DEVICE

BACKGROUND OF THE INVENTION

The present invention relates to coaxial cable connectors used in communication systems. More particularly, the present invention relates to improved methods and apparatuses for connecting a coaxial cable to a bulk head.

One of the most commonly used transmission lines in the communication industry is the coaxial cable. A coaxial cable is an electrically conducting transmission line configured for carrying signals to and from different types of circuits. More specifically, coaxial cables are configured to have an inner conductor and outer conductor, which are separated by a dielectric insulator and externally covered by an outer insulator. Generally, the inner conductor is configured for carrying the signal and the outer conductor is configured for shielding the inner conductor. For example, the outer conductor prevents energy from radiating from the inner conductor and blocks the pickup of external signals that might interfere with the reception and/or transmission of the signal carried by the inner conductor (e.g. interference).

Because the coaxial cable can prevent interference, it is commonly used in communication systems such as radio, TV, telephony, data and information destined for microwave transmission. In one specific application, the coaxial cable is used to carry signals between an antenna and a transmitter and/or a receiver. Referring initially to FIG. 1, an exemplary communication system 10 that uses a coaxial cable to connect an antenna to a transmitter/receiver is shown. Communication system 10 typically includes an antenna 12 (or group of antennas) that is structurally disposed on a tower 14. By way of example, the antenna 12 may be a "whip" type antenna, a FM antenna, a microwave type antenna, or a panel type antenna. The antenna 12 is operatively coupled to a coaxial cable 16 that runs down the tower 14 to a transmitter and/or receiver (not shown) housed in a transmitter/receiver station 18.

Furthermore, as the coaxial cable 16 enters the transmitter/receiver station 18, it is typically coupled to a bulkhead (not shown), which is designed to support the coaxial cable 16. In some instances, the bulkhead may also be referred to as an entry port. The bulkhead may be configured to be a single point of entry that may be common to many coaxial cables that originate from multiple antennas on the tower (or towers) or it may be configured to support a single coaxial cable. By way of example, there may be as many as twenty antennas on one tower, and as many as sixteen cables (or more) coupled to the bulk head (or entry port) at one time. Following connection to the bulkhead, the coaxial cable is further connected to a specific transmitter or receiver inside the transmitter/station.

When using coaxial cables, especially in communication systems, it is important to use connectors that connect the outer conductor of the coaxial cable to ground. Grounding the outer conductor further helps to dissipate interference from other signals. Therefore, the coaxial cable is typically coupled to a grounded bulkhead. For the most part, the grounded bulk head is formed from a highly conductive material such as brass or copper and coupled to a ground strip that is further coupled to a grounding system (shown in FIG. 1 as grounding system 20). The grounding system, which is typically part of the transmitter/receiver equipment, may be useful for addressing issues associated with lightning strikes. Grounding systems are well known in the art and for the sake of brevity will not be discussed in detail here.

Presently, a wide variety of coaxial connectors have been provided for connecting a coaxial cable to a bulkhead. In a typical coaxial connector, the coaxial cable is cut in half (in a direction perpendicular to the cable axis), the exposed cable ends are stripped of insulation and the bare outer conductor is inserted into a pair of coaxial connectors where they can be secured to each of the coaxial connectors. More specifically, a collar is secured to each of the stripped ends and locked in place between a locking nut and each of the coaxial connectors. The pair of coaxial connectors are then coupled to the bulkhead.

Referring to FIGS. 2 & 3, a typical coaxial connector system 50 is shown. The coaxial connector system 50 includes a cut coaxial cable 56. The cut coaxial cable 56 is arranged to include an inner conductor 44, an outer conductor 46, an inner insulator 48 (i.e., foam, plastic coil separator, etc.) disposed between the inner and the outer conductor (44, 46), and an outer insulator 49 disposed around the outer conductor 46. Further, the coaxial connector system 50 includes a pair of cable couplers 52 that are coupled to each of the stripped ends 54 of the cut coaxial cable 56. The cable couplers 52 are coupled to the stripped ends 54 by securing a collar 58 around the stripped ends 54 of coaxial cable 56, and thereafter locking the collar 58 between a locking nut 60 and the cable coupler 52.

The cable couplers 52 are formed from a conductive material, and in electrical contact with the outer conductor 46 when secured to the stripped ends 54. Furthermore, a conductive pin 62 is disposed between the inner conductors 44 of the cut coaxial cable 56, in order to electrically connect the broken inner conductor circuit. Following the coupling of the cable couplers to the cut coaxial cable 56, the cable couplers 52 are disposed together and fastened to a grounded bulk head 64. In most instances, the fastening of the cable couplers 52 to the grounded bulkhead 64 is implemented with a plurality of bolts 66.

One problem that has been encountered with the coaxial connector system has been that the coaxial cable is cut in half. As is well known to those skilled in the art, the ability of the coaxial cable to carry a signal is reduced with every cut or break. By way of example, a cut may produce signal reflections that weaken the signal as it is transmitted through the coaxial cable. Signal reflections make it difficult to obtain maximum power transfer through the coaxial cable. Additionally, the cut makes it difficult to achieve proper contact between the conductors of the coaxial cable. Poor connection between mating conductors also leads to weakened signal transmissions.

Furthermore, by cutting the coaxial cable in half, the connection has to be waterproofed to ensure that moisture does not adversely impact the connection. For example, signal loss tends to occur when moisture saturates the conductive path of the conductors. Moisture also tends to corrode the conductors. Referring back to FIG. 2 & 3, the prior art overcomes these disadvantages by disposing a shrink wrap tube 68 over the locking nut 60 and the unstripped portion of the cut coaxial cable 56, and providing an o-ring 70 between the pair of cable couplers 52. Although FIG. 2 and 3 show the shrink wrap tube extending only partially over the cable coupler 52, it should be understood that the shrink wrap tube 68 may be configured with varying lengths and may even extend to the flanged portion of the cable coupler 52. For the most part, the shrink wrap tube 68 prevents the introduction of moisture at the locking nut/coaxial cable interface and the o-ring 70 prevents the introduction of moisture at the cable coupler/cable coupler interface. However, the additions of the shrink wrap tube and the o-ring further increase the complexity and cost of the connection and may loose their sealing ability over a period of time.

Further still, the coaxial connector system is complex, heavy and difficult to handle. The amount of parts (one for each cut end), e.g., cable coupler, collar, locking nut, conductive pin, o-ring, increases the coaxial connector system assembly time and makes it difficult to install. In fact, it typically takes two people to install the coaxial cable and coaxial connectors to the bulkhead. Correspondingly, the use of complex parts and increased man hours lead to increased costs.

In view of the foregoing, there are desired improved methods and apparatuses for electrically and mechanically coupling a coaxial cable to a bulk head. Additionally, there are desired improved methods and apparatuses for providing a substantially weatherproof connection between coaxial cable and a bulkhead. Also, there are desired improved methods and apparatuses that reduce the costs associated with coupling a coaxial cable to a bulkhead.

SUMMARY OF THE INVENTION

The invention relates, in one embodiment, to a connector assembly for coupling a continuous length of coaxial cable to a bulkhead. The coaxial cable includes an insulation layer disposed around an outer conductor. The connector assembly includes a first conductive mounting member having an inner peripheral surface that is configured to mate with an outer peripheral surface of the outer conductor for a segment of the continuous length of the coaxial cable. The first conductive mounting member also includes a first bulkhead mating portion that is configured to mate with the bulkhead. The connector assembly further includes a fastener that is configured to couple the first conductive mounting member to the outer conductor of the segment of the continuous length of the coaxial cable, wherein the continuous length of the coaxial cable is uninterrupted within the connector assembly.

The invention relates, in another embodiment, to a connector system for coupling a coaxial cable to a surface. The connector system includes a grounded bulk head. The connector system further includes a continuous length of coaxial cable. The continuous length of coaxial cable includes an insulator layer disposed around an outer conductor. The connector system also includes a conductive sleeve coupled to the continuous length of coaxial cable. The conductive sleeve being configured to mate with the outer peripheral surface of the outer conductor of a segment of the continuous length of coaxial cable. The conductive sleeve further being coupled to the grounded bulk head.

The invention relates, in another embodiment, to a method of coupling an outer conductor of a continuous length of coaxial cable to a grounded bulk head. The coaxial cable includes an insulator layer disposed around the outer conductor. The method includes removing a portion if the insulator layer from the continuous length of coaxial cable, and exposing a segment of the outer conductor of the continuous length of coaxial cable. The method further includes coupling a conductive sleeve around the segment of the outer conductor of the continuous length of coaxial cable. The method additionally includes coupling the conductive sleeve to the grounded bulk head, wherein the conductive sleeve mechanically and electrically couples the outer conductor of the continuous length of coaxial cable to the grounded bulk head and wherein the segment of the outer conductor is uninterrupted within the conductive sleeve.

DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be obvious, however, to one skilled in the art, that the present invention may be practiced without some or all of these specific details. In other instances, well known process steps have not been described in detail in order not to unnecessarily obscure the present invention.

The present invention provides a connector assembly for coupling a coaxial cable to a bulkhead without cutting through the coaxial cable. The connector assembly includes a mounting member that is configured to substantially surround a segment of an outer peripheral surface of the outer conductor of a continuous length of coaxial cable. The term "continuous length of coaxial cable" herein encompasses an uncut or unbroken length of coaxial cable. Further, the inner peripheral surface of the mounting member is configured to coincide with the shape of the outer peripheral surface of the outer conductor of the continuous length of coaxial cable, and also includes an outer surface that is configured to mate with the bulkhead. Further still, the connector assembly includes a fastener that is configured to couple the mounting member to the segment of the outer peripheral surface of continuous length of coaxial cable.

Figure 1:
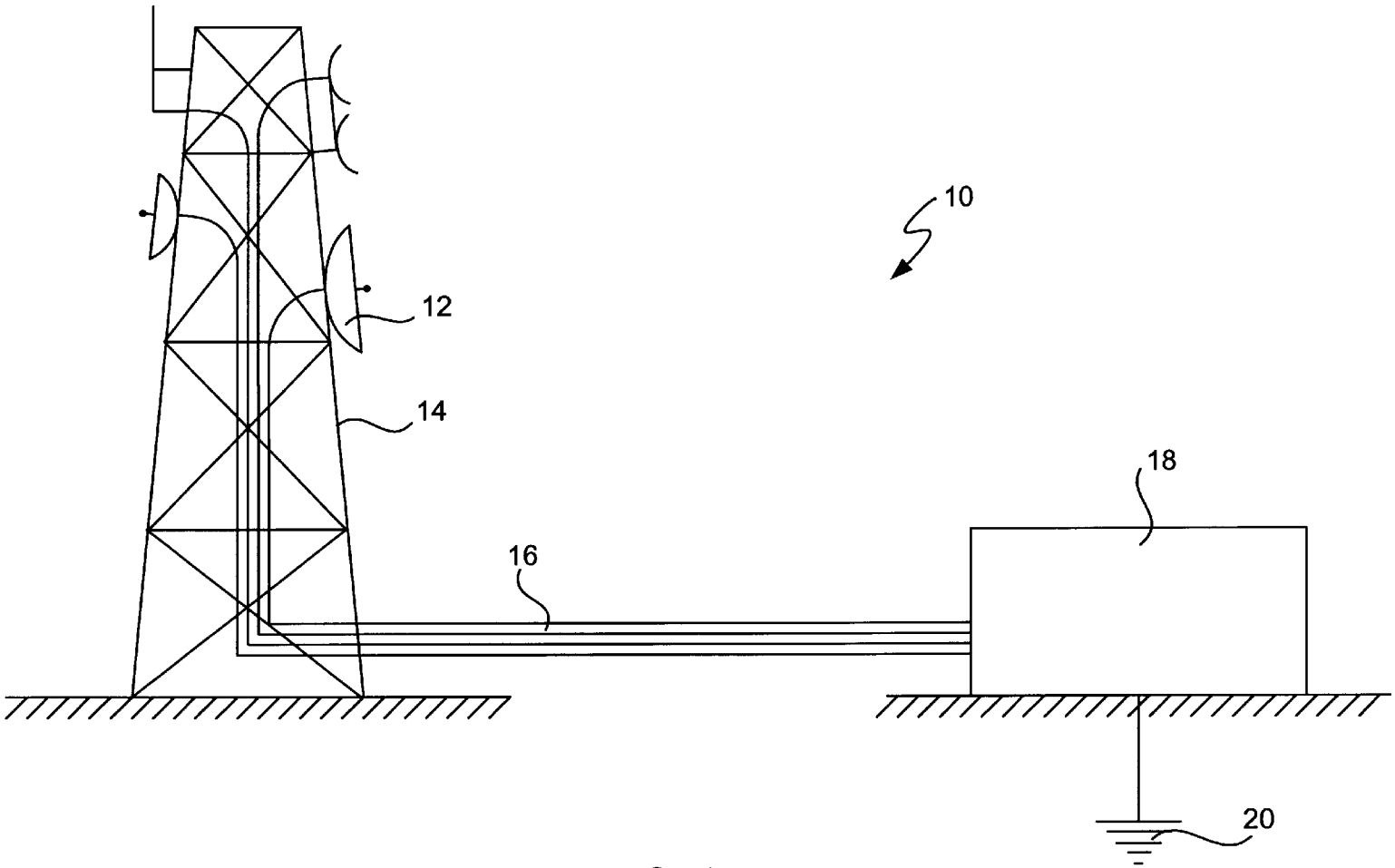
FIG. 1 (PRIOR ART)
FIG. 1 illustrates a typical communication system.
Figure 2:
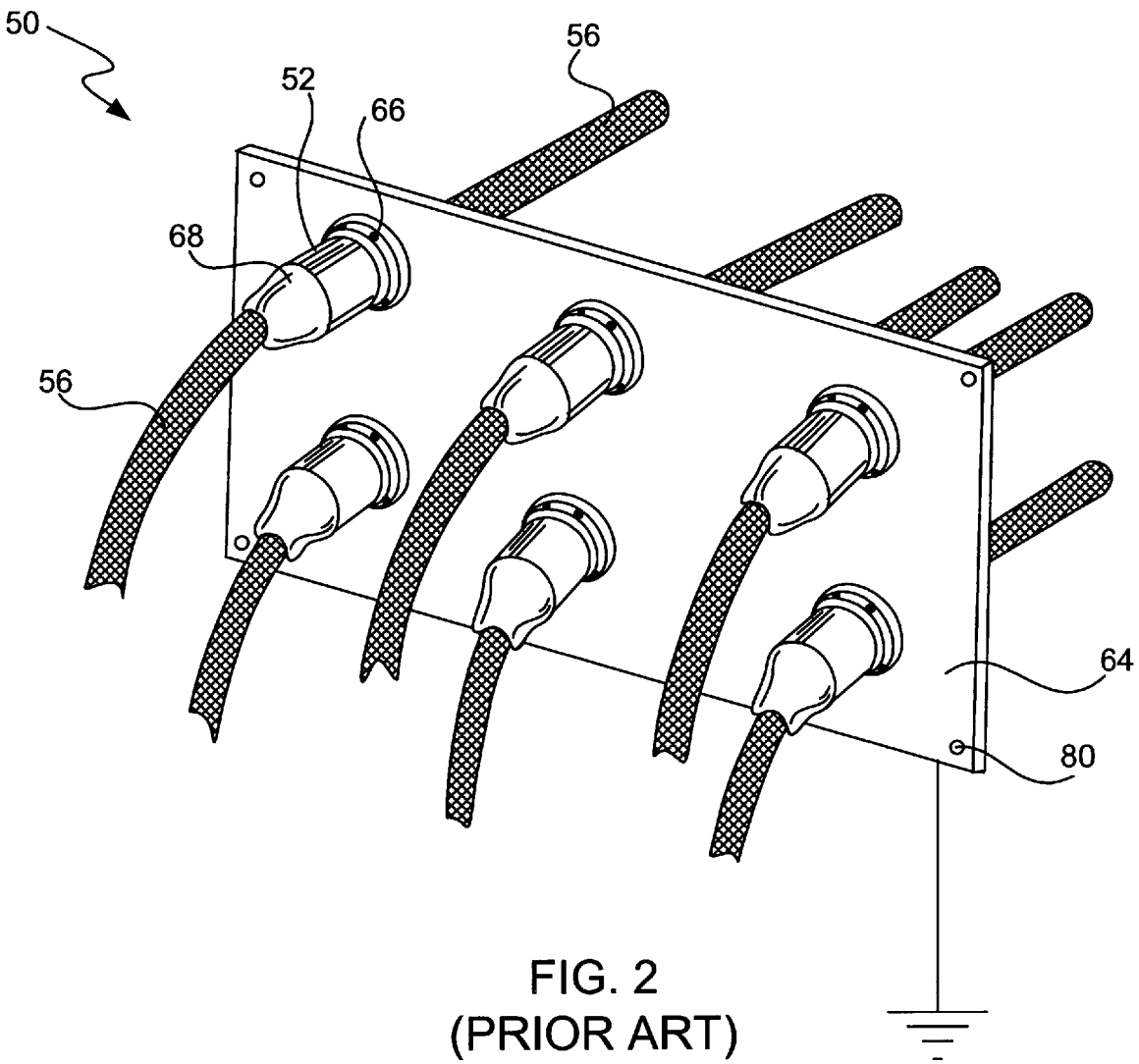
FIG. 2 (PRIOR ART)
FIG. 2 is a perspective diagram of a bulk head with multiple coaxial cables connected thereto.
Figure 3:
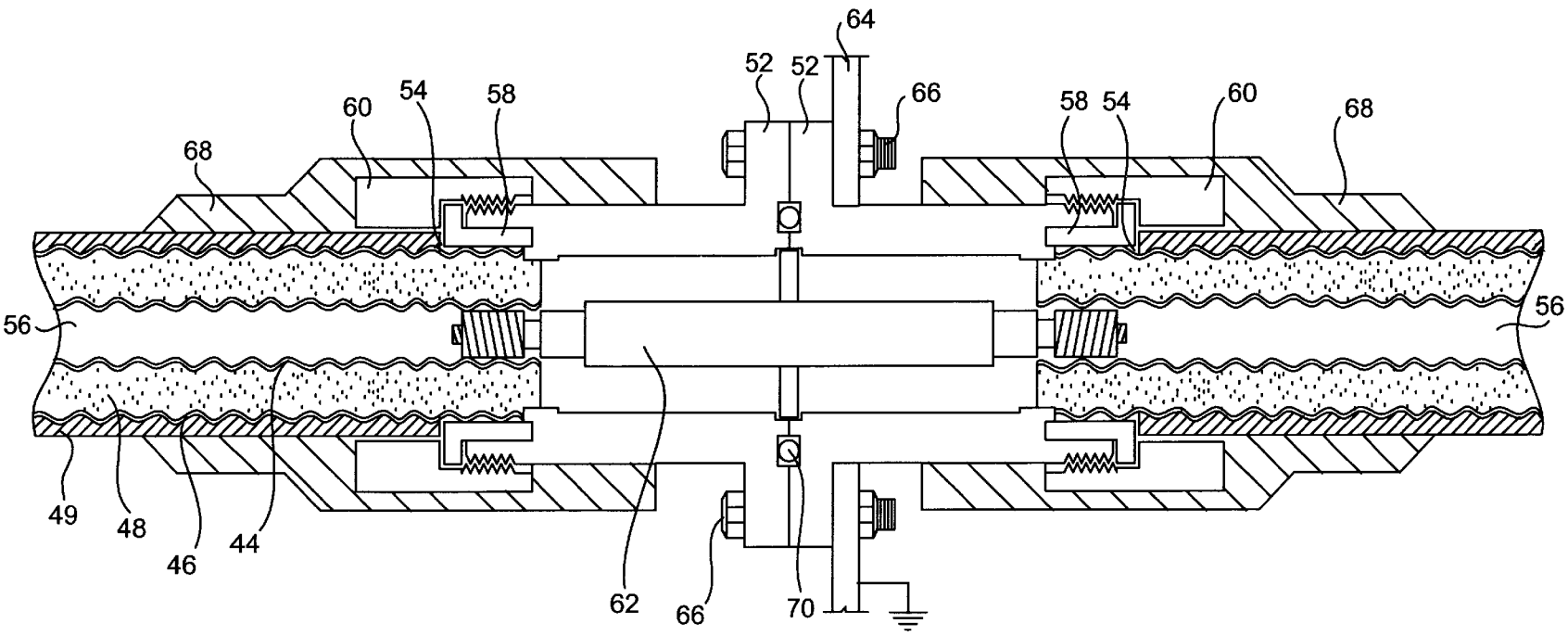
FIG. 3 (PRIOR ART)
FIG. 3 is a schematic diagram of a prior art coaxial connector coupled to a bulk head.
Figure 4:
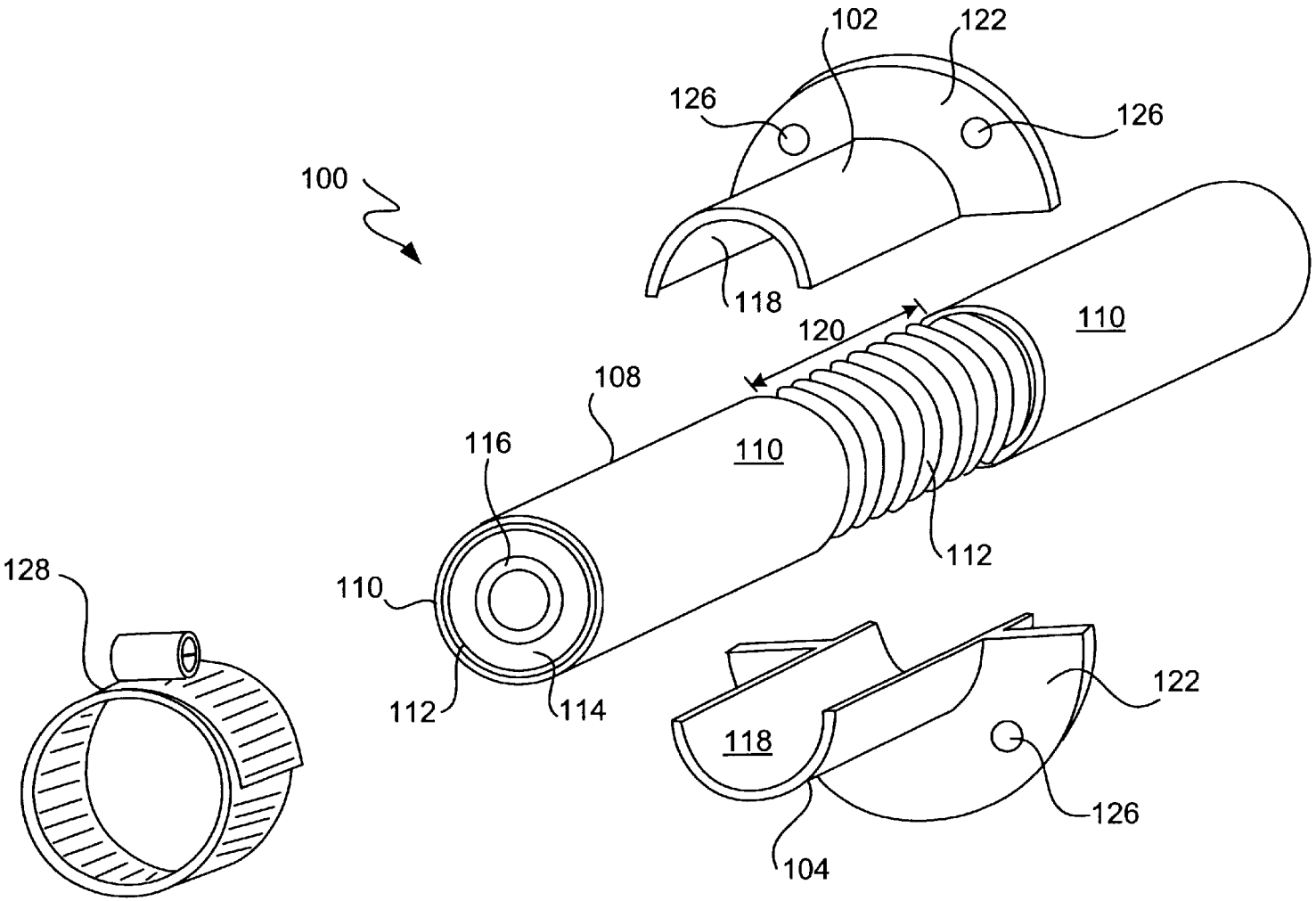
FIG. 4 is a broken away perspective diagram of a connector assembly configured to couple a coaxial cable to a bulk head, in accordance with one embodiment of the present invention.

To facilitate discussion of the above aspects of the present invention, FIGS. 4 & illustrate a connector assembly 100 configured to couple a continuous length of coaxial cable 108 to a bulkhead 132, in accordance with one aspect of the present invention. The continuous length of coaxial cable 108 is conventional, and therefore includes an outer insulator 110 disposed around an outer conductor 112. The outer conductor 112 is disposed around an inner insulator 114, and the inner insulator 114 is disposed around an inner conductor 116. Furthermore, the bulkhead 132 (or entry port) is conventional (e.g., grounded), and includes a plurality of openings configured to coincide with the connector assembly 100. The plurality of openings will be described in detail below.

In one embodiment of the present invention, the connector assembly 100 is configured to surround a predetermined segment 120 of the outer conductor of the length of coaxial cable 108. Preferably, the connector assembly 100 includes a first mounting member 102 and a second mounting member 104. Both the first and second mounting members 102, 104 are substantially similar semi-circular annular sleeves that are configured to substantially surround the outer conductor of the continuous length of coaxial cable 108. However, it should be noted that the mounting member is not limited by two sleeves (e.g., mounting members) and may be configured as a single circular annular sleeve or be configured as two or more sleeves that surround the predetermined segment of the continuous length of coaxial cable.

To elaborate further, the first and second mounting members 102, 104 have an inner peripheral surface 118 that is configured to coincide with the shape of an outer peripheral surface of the outer conductor of the continuous length of coaxial cable 108. Coaxial cable typically comes in standard sizes ranging from about ⅜ to 6 inches in diameter, and therefore, the mounting members 102, 104 when aligned together are configured to have an inner diameter that is substantially similar to the outer diameter of the outer conductor of one of the standard sizes of coaxial cable. Furthermore, the mounting members 102, 104 have a length that coincides with the predetermined segment 120 of the continuous length of coaxial cable 108. As a result, the outer conductor of the predetermined segment 120 of the continuous length of coaxial cable 108 may be received and enclosed by the mounting members 102, 104 when the mounting members 102, 104 are in contact and disposed around the outer peripheral surface of the outer conductor of the continuous length of coaxial cable 108.

In a preferred embodiment of the present invention, the connector assembly 100 is arranged to be in electrical contact with the outer conductor of the continuous length of coaxial cable 108. That is, the outer peripheral surface of the continuous length of the coaxial cable 108 that is received by the inner peripheral surface 118 of the mounting member 102, 104 is the outer conductor 112 of the continuous length of coaxial cable after the continuous length of coaxial cable is stripped of the insulation layer 110. The stripped insulation layer 110 and exposed outer conductor 112 is preferably the predetermined segment 120. In one embodiment, the predetermined segment 120, and thus the stripped portion of the continuous length of coaxial cable 108, is about 2 inches.

The mounting members 102, 104 also include a bulkhead mating element 122 that is configured to be coupled to the bulkhead 132. In one embodiment, the bulkhead mating element 122 extends outwardly away from the outer peripheral surface of the mounting members 102, 104. For the most part, the bulkhead mating element 122 may be positioned anywhere along the length of the mounting members 102, 104. Preferably, the bulkhead mating element 122 is positioned such that when the bulkhead mating element 122 is coupled to a bulkhead there are sufficient lengths of mounting members 102 (and/or 104) extending axially in both directions to securely grip the coaxial cable and/or provide stress relief.

Additionally, the mounting members 102, 104 include a securing mechanism configured for coupling the bulkhead mating element 122 to the bulkhead 132. Preferably, the securing mechanism includes a plurality of apertures 126 that are arranged on the bulkhead mating element 122 and configured to accept a bolt 130. Therefore, the connector assembly 100 can be coupled to the bulkhead 132 by bolting the mounting members 102, 104 to the bulkhead 132. However, it should be noted that the bulkhead mating surface and securing mechanism are not limited by the above description and may be configured in a variety of ways. For example, the securing mechanism may be implemented with welds, springs, threads, fasteners, slots, etc.

Accordingly, the mounting members 102, 104 are configured to provide a conductive path, which electrically couples the outer conductor 112 to the grounded bulkhead 132. Therefore, the mounting members 102, 104 are preferably formed from a conductive material, such as copper or brass. Copper and brass also provide other important material properties, which include but are not limited to, non-corrosiveness and strength. Although only copper and brass have been discussed, it should be borne in mind that other materials that provide the same material properties may be used. Further, it should be noted that if an electrical connection is not desired, the mounting members 102, 104 may be arranged to surround the outer insulator of the coaxial cable and/or be formed from a non-conducting material.

In one embodiment, the mounting members 102, 104 and bulkhead 132 are formed from substantially similar materials. As mentioned, the bulkhead 132 is grounded through a grounding strip to a grounding system. Therefore, the outer conductor 112 is substantially grounded by electrically connecting the outer conductor 112 to the bulkhead 132 through the connector assembly 100.

Further the mounting members are preferably cast. Casting is one of the less expensive ways to manufacture the mounting members, especially because the mounting members are formed from simple shapes and are symmetrical. However, it should be noted that the mounting members may be formed by any conventional manufacturing technique such as machining, welding and the like.

The connector assembly 100 also includes a fastener 128 that is configured to couple the first and second mounting members 102, 104 to the outer peripheral surface of the continuous length of coaxial cable 108. In one embodiment, the fastener is configured to force contact between the mounting members 102, 104 and the outer conductor of the continuous length of coaxial cable 108. Essentially, the fastener 128 provides a compressive force that couples the mounting members 102, 104 to the continuous length of coaxial cable 108, thereby forming a secured and layered structure. In one embodiment, the fastener is a clamp. More specifically, the clamp is a standard stainless steel hose clamp. The stainless steel hose clamp is preferably arranged to be disposed around the outer peripheral surface of the mounting members 102, 104 when the mounting members 102, 104 are disposed around the continuous length of coaxial cable 108.

However, it should be noted that the present invention is not limited by a hose clamp and that any conventional fastening system may be used. For example, the mounting members may include portions that are configured to be coupled together with a bolt, a spring, a weld, a crimp, a threaded portion, etc. Further, the fasteners may be separate parts or integrally formed with the mounting members. In fact, the mounting members may be configured with a hinge, and therefore, only one side of the mounting members need to be configured with a fastener. A hinge offers the added benefit of reducing the amount of loose parts associated with the connector assembly.

Furthermore, if a single cylindrical annular sleeve is used for the mounting member (in which case, the inner diameter of the sleeve may be dimensioned slightly larger than the outer periphery of the coaxial cable to allow the sleeve to slide into position) then a tightening bolt may be used to apply a compressive force to secure the connector assembly to the coaxial cable and/or to provide electrical contact with the outer conductor. Further, the tightening bolt may include coaxial cable contact portions that increase the surface contact between the coaxial cable and the connector assembly when secured. For example, the coaxial cable contact portions may be configured as two sleeves that are connected to a screw that mechanically moves the sleeves together so as to apply a compressive force and secure the connector assembly to the coaxial cable.

Figure 5:
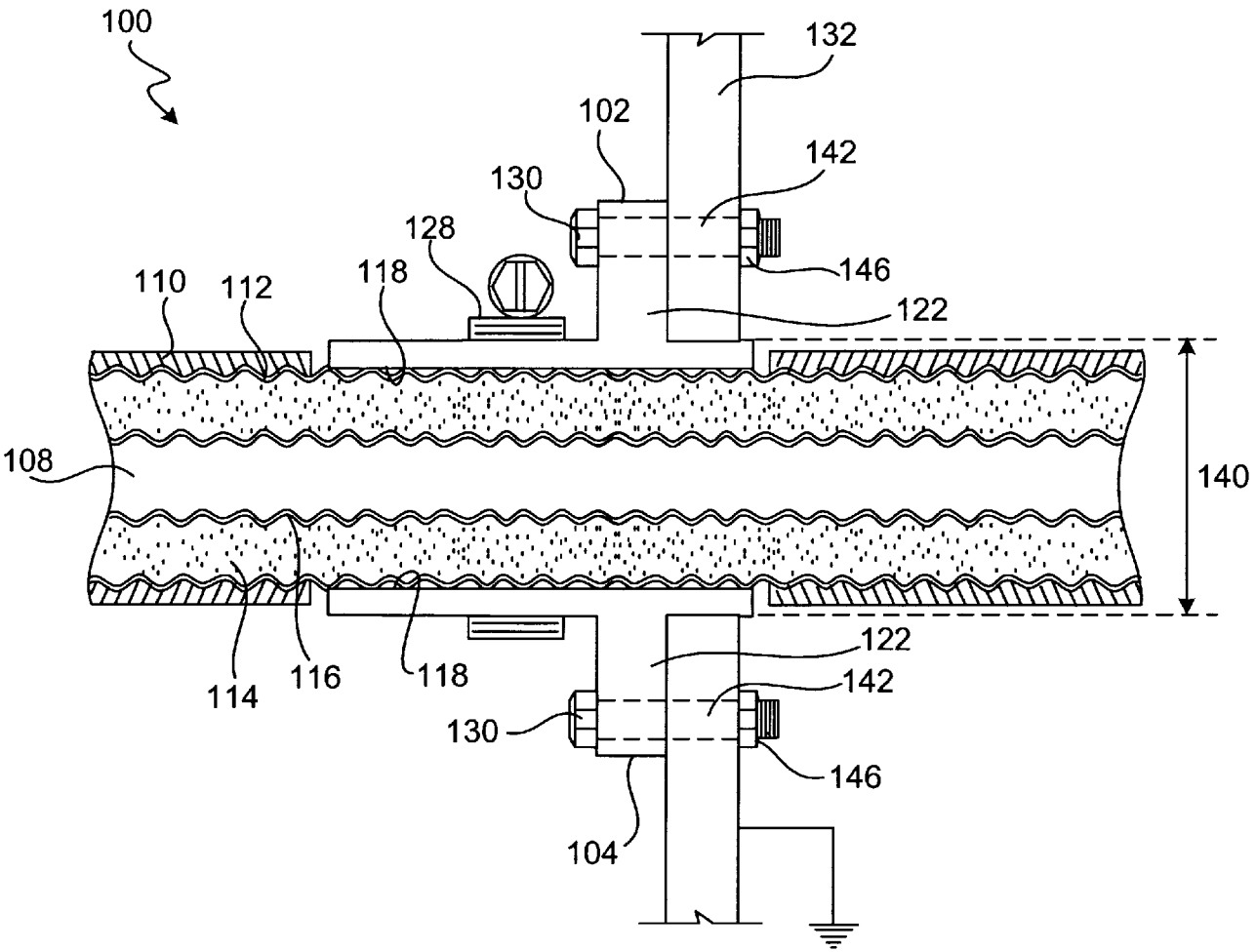
FIG. 5 is a schematic diagram of a connector assembly coupled to a bulk head, in accordance with one embodiment of the present invention.

The method of assembling and installing the connector assembly 100 to the continuous length of coaxial cable 108 and the bulkhead 132 will now be described with reference to FIGS. 4 and 5. Prior to assembling the connector assembly 100, bulkhead preparations that are conventional and readily understood by those skilled in the art are performed. For example, a plurality of openings may first be formed in the bulkhead 132. The openings include a connector assembly opening 140 that is configured to accept the connector assembly 100, and a plurality of fastening openings 142 that are configured to coincide with the plurality of apertures 126 disposed in the bulkhead mating element 122 of the connector assembly 100. Preferably, the connector assembly opening 140 is configured to be slightly larger than outer perimeter of the mounting members 102, 104 in order to allow some degree of alignment of the fastening openings 142 of the bulkhead 132 to the plurality of apertures 126 of the connector assembly 100 (e.g., allow a little bit of play). Conventional techniques for forming the openings are used, for example, using a template for the determining the proper location of the openings on the bulkhead and thereafter drilling the openings.

After the openings are formed, the coaxial cable is inserted through the connector assembly opening 140, and the position, along the continuous length of coaxial cable 108, for proper placement of the connector assembly 100 on the continuous length of coaxial cable is determined. Once the position is determined, a segment (e.g. predetermined segment 120) of the outer insulator 110 is stripped and removed in a conventional manner (e.g., using a sharp knife or pipe cutter) to expose a length of the outer conductor 112. Mounting members 102, 104 are then disposed around the outer periphery of the exposed length of the outer conductor 112 so that the inner peripheral surface 118 of the mounting member mates with the outer peripheral surface (e.g., outer conductor) of the predetermined segment 120 of the continuous length of coaxial cable 108. Thereafter, the fastener 128 is disposed around the mounting members and fastened to couple the mounting members 102, 104 to the predetermined segment 120 of the continuous length of coaxial cable 108.

More particularly, the connector assembly 100 is clamped on the outer conductor 112 using a stainless steel hose clamp.

Following fastening of the connector assembly 100, the connector assembly 100 and coaxial cable 108 are disposed in the connector assembly opening 140 in the bulkhead 132. The plurality of apertures 126 in the bulkhead mating element 122 of the mounting members 102, 104 are then aligned with the fastening openings 142 of the bulkhead 132. Thereafter, a plurality of bolts 130 are inserted through the plurality of apertures 126 and the aligned fastening openings 142 and secured with a nut 146 on the opposite side of the bulkhead 132 to couple the connector assembly 100 to the bulkhead 132. Accordingly, the connector assembly 100 mechanically and electrically couples the continuous length of coaxial cable 108 to the bulkhead 132 without cutting through the continuous length of coaxial cable 108.

According to another aspect of the present invention, a sizing insert is provided with the mounting members so that different sized coaxial cables may be used with the connector assembly. The sizing insert is preferably configured to fill the space between the inner peripheral surface of the mounting members and the outer peripheral surface of the outer conductor of the coaxial cable. By providing the conductive insert, a single connector assembly may be employed with coaxial cables of different sizes.

Figure 6:
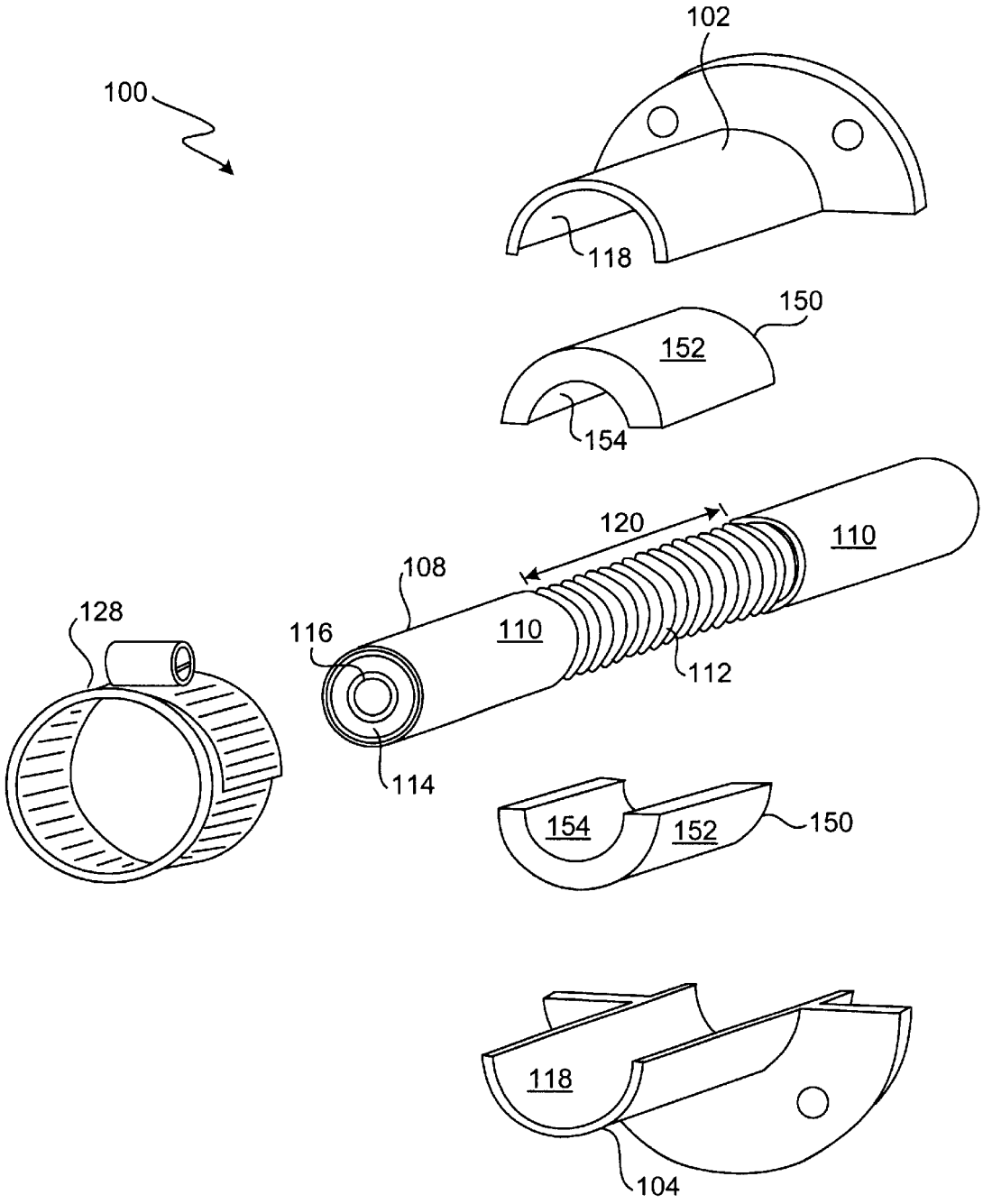
FIG. 6 is a broken away perspective diagram of a connector assembly that includes inserts for allowing the connector assembly to be fastened to different sizes of coaxial cable, in accordance with one embodiment of the present invention.

To facilitate discussion of this advantageous aspect of the present invention, FIG. 6 illustrates a broken away perspective view of the connector assembly 100 of FIG. 4 with the addition of sizing inserts 150, in accordance with one embodiment of the present invention. As shown, the sizing inserts 150 are configured with an outer peripheral surface 152 that mates with the inner peripheral surface 1 18 of the mounting member 102, 104. Further, the sizing inserts are configured with an inner peripheral surface 154 that mates with the outer peripheral surface of the outer conductor of a continuous length of coaxial cable 108. Basically, the sizing inserts fill the gap between the mounting members 102, 104 and the outer conductor of smaller sized coaxial cables. Thus, one set of mounting members 102, 104 may be used for different sizes of coaxial cable. By way of example, if the mounting members are configured to receive a 2 inch coaxial cable, but a 1 inch coaxial cable is provided, then a pair of ½ inch sizing insert may be used to couple the 1 inch coaxial cable to the 2 inch coaxial cable mounting member.

Further the sizing inserts are formed from substantially the same conductive material as the mounting members 102, 104. Further, the sizing insert 150 may be configured to have substantially the same length as the mounting members 102, 104, a length that substantially coincides with the predetermined segment 120. However, it should be noted that any length that provides enough electrical and mechanical contact may be used.

As can be seen from the foregoing, the present invention offers numerous advantages over the prior art. By way of example, the invention allows the coaxial cable to be coupled to the bulkhead without cutting through the coaxial cable. Thus, the invention eliminates losses due to reflection and bad connections. Further, weather proofing the connection is not as important because moisture cannot penetrate through the coaxial cable because the coaxial cable is uncut. Additionally, the use of sizing inserts allows the present invention to work with a number of different sized coaxial cables.

Furthermore, the present invention is several orders of a magnitude less expensive than the prior art. For example, the prior art uses parts unnecessary if the coaxial cable remains intact (i.e., parts for weatherproofing, connecting the inner connector, etc.). Also, the prior art coaxial connectors have included complex designs, such as threads, that need to be machined. Increased machining tends to add costs to the production of the parts. Moreover, installation of the present invention is quick and easy. In contrast, the prior art coaxial connector can take several hours to install, and may require two men.

While this invention has been described in terms of several preferred embodiments, there are alterations, permutations, and equivalents which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed:

1. A connector assembly for coupling a continuous length of coaxial cable to a bulkhead, said coaxial cable including an insulation layer disposed around an outer conductor, said connector assembly comprising:

a first conductive mounting member having a first inner peripheral surface that is configured to mate with an outer peripheral surface of said outer conductor for a segment of said continuous length of said coaxial cable, and a first outer peripheral surface having a first bulkhead mating portion member extending perpendicularly therefrom between opposite ends of said first conductive mounting member, said first bulkhead mating portion member being configured to mate with said bulkhead, and including a first through hole having a first axis that is parallel to said first outer peripheral surface, said first through hole being configured to permit a first bolt to pass therethrough so as to mount said first conductive mounting member to said bulkhead; and a fastener that is configured to couple said first conductive mounting member to said outer conductor of said segment of said continuous length of said coaxial cable, wherein said continuous length of said coaxial cable is uninterrupted within said connector assembly, wherein said first conductive mounting member electrically couples said outer conductor to said bulk head when said first conductive mounting member is mounted to said bulkhead.

2. The connector assembly as recited in claim 1 wherein said first conductive mounting member is formed from copper or brass.

3. The connector assembly as recited in claim 1 wherein said bulkhead is grounded.

4. The connector assembly as recited in claim 1 further including a second conductive mounting member configured to be coupled to said first mounting member and said outer conductor, said second conductive mounting member having a second inner *peripheral surface that is configured to mate with said outer peripheral surface of said outer conductor for a segment of said continuous length of said coaxial cable, and a second outer peripheral surface having a second bulkhead mating portion member extending perpendicularly therefrom between opposite ends of said second conductive mounting member, said second bulkhead mating portion member being configured to mate with said bulkhead, and including a second through hole having a second axis that is parallel to said second outer peripheral surface, said second through hole being configured to permit a second bolt to pass therethrough so as to mount said second conductive mounting member to said bulkhead.

5. The connector assembly as recited in claim 4 wherein said first and second conductive mounting members represent a pair of semi-circular annular sleeves.

6. The connector assembly as recited in claim 5 wherein said pair of semi-circular annular sleeves are coupled together with said fastener.

7. The connector assembly as recited in claim 6 wherein said fastener is a hose clamp.

8. The connector assembly as recited in claim 4 wherein said connector assembly further includes a first conductive sizing insert and a second conductive sizing insert, said first conductive sizing insert being configured to fill a space between said first inner peripheral surface of said first conductive mounting member and said outer peripheral surface of said outer conductor of said continuous length of coaxial cable, and said second conductive sizing insert being configured to fill a space between said second inner peripheral surface of said second conductive mounting member and said outer peripheral surface of said outer conductor of said continuous length of coaxial cable.

9. The connector assembly as recited in claim 8 wherein said first and second sizing inserts are movable relative to the first and second conductive mounting members.

10. The connector assembly as recited in claim 5 wherein said first bulkhead mating portion member extends radially from said first conductive mounting member, and wherein said second bulkhead mating portion member extends radially from said second conductive mounting member.

11. The connector assembly as recited in claim 1 wherein said first bulkhead mounting portion is positioned axially along said first mounting member such that said first conductive mounting member extends axially from said first bulkhead mounting portion to support said coaxial cable when said first bulkhead mounting portion is coupled to said bulkhead.

12. The connector assembly as recited in claim 1 wherein said coaxial cable is an antenna coaxial cable.

13. The connector assembly as recited claim 1 wherein said coaxial cable has a diameter of between about 1 inch and about 3 inches.

14. The connector assembly as recited claim 1 wherein said connector assembly further includes a sizing insert, said sizing insert being configured to fill a space between the inner peripheral surface of said first mounting member and the outer peripheral surface of said outer conductor of said continuous length of coaxial cable.

15. The connector assembly as recited in claim 14 wherein said sizing insert is conductive.

16. The connector assembly as recited in claim 5 wherein at least one end of said first conductive mounting member is configured for placement within an opening in said bulkhead such that a portion of said coaxial cable extends through said opening in said bulkhead when said first conductive mounting member is mounted to said bulkhead.

17. A connector system for grounding a coaxial cable, said connector system comprising:

a grounded bulk head;

a continuous length of coaxial cable, said continuous length of coaxial cable and to said grounded bulkhead, said conductive annular sleeve having a circular inner peripheral surface configured to electrically mate with the outer peripheral surface of said outer conductor of a segment of said continuous length of coaxial cable, a circular outer peripheral surface extending radially from the circular inner peripheral surface, and a contact surface configured to electrically mate with said grounded bulk head, said contact surface extending perpendicularly from said circular outer peripheral surface, said conductive annular sleeve including an end configured for placement within an opening in said grounded bulkhead.

18. A connector assembly for coupling a continuous length of coaxial cable to a grounded bulkhead, said grounded bulkhead including an opening for receiving the connector assembly, said coaxial cable including an insulation layer disposed around an outer conductor, said coaxial cable having a segment of said insulation layer removed to expose an outer peripheral surface of said outer conductor, said connector assembly comprising:

a first semi-circular annular sleeve formed from a conductive material and having a first inner peripheral surface and a first outer peripheral surface, the first inner peripheral surface being configured to receive a first portion of the outer peripheral surface of the outer conductor, said first semi-circular annular sleeve having a first flange extending radially from the first outer peripheral surface, the first flange having a first contact surface for mounting the first sleeve to the grounded bulkhead, said first flange dividing said first sleeve longitudinally into a first end and a second end;

a second semi-circular annular sleeve formed from a conductive material and having a second inner peripheral surface and a second outer peripheral surface, the second inner peripheral surface being configured to receive a second portion of said outer peripheral surface of said outer conductor, said second semi-circular annular sleeve having a second flange extending radially from the second outer peripheral surface, the second flange having a second contact surface for mounting the second sleeve to the grounded bulkhead, the second flange dividing said second sleeve into a first end and a second end; and a fastener for sandwiching the exposed coaxial cable between the said first semi-circular annular sleeve and said second semi-circular annular sleeve, wherein the second ends of the first and second sleeves are configured for insertion into the opening in the grounded bulkhead when the exposed coaxial cable is sandwiched between said first semi-circular annular sleeve and said second semi-circular annular sleeve.

* * * * *